US008610584B2

(12) United States Patent
Chiou et al.

(10) Patent No.: US 8,610,584 B2
(45) Date of Patent: Dec. 17, 2013

(54) FALL-DOWN ALARM SYSTEM

(75) Inventors: Jin-Chern Chiou, Taichung (TW); Tsann Lin, Taichung (TW); Shih-Che Lo, Taichung (TW); Jeng-Ren Duann, Taichung (TW); Sheng-Chuan Liang, Taichung (TW); Yung-Jiun Lin, Taichung (TW)

(73) Assignee: China Medical University, Taichung (TW)

( * ) Notice: Subject to any disclaimer, the term of this patent is extended or adjusted under 35 U.S.C. 154(b) by 243 days.

(21) Appl. No.: 13/186,763

(22) Filed: Jul. 20, 2011

(65) Prior Publication Data

US 2012/0019387 A1 Jan. 26, 2012

(30) Foreign Application Priority Data

Jul. 22, 2010 (TW) ..... 99124116 A

(51) Int. Cl.
*G08B 23/00* (2006.01)

(52) U.S. Cl.
USPC ..... 340/573.1; 340/689; 340/572.1

(58) Field of Classification Search
USPC ..... 340/573.1, 573.7, 689, 575, 573.4, 340/572.1
See application file for complete search history.

(56) References Cited

U.S. PATENT DOCUMENTS

| | | | | |
|---|---|---|---|---|
| 6,129,686 | A * | 10/2000 | Friedman | 600/595 |
| 2004/0097837 | A1* | 5/2004 | Brandon et al. | 600/587 |
| 2006/0282021 | A1* | 12/2006 | DeVaul et al. | 600/595 |
| 2009/0115610 | A1* | 5/2009 | Steinhage et al. | 340/572.1 |
| 2009/0224925 | A1* | 9/2009 | Gannot et al. | 340/573.1 |
| 2009/0322513 | A1* | 12/2009 | Hwang et al. | 340/539.12 |
| 2010/0097013 | A1* | 4/2010 | Inskeep | 315/360 |
| 2010/0286567 | A1* | 11/2010 | Wolfe et al. | 600/587 |

FOREIGN PATENT DOCUMENTS

| | | |
|---|---|---|
| TW | 200912814 | 3/2009 |
| TW | 200919382 | 5/2009 |

* cited by examiner

*Primary Examiner* — Daniel Previl
(74) *Attorney, Agent, or Firm* — Muncy, Geissler, Olds & Lowe, PLLC

(57) ABSTRACT

A fall-down alarm system includes a contact detection unit, a non-contact detection unit and a fall-down evaluation unit connecting respectively to the contact detection unit and non-contact detection unit. The contact detection unit and non-contact detection unit respectively detect an abnormal detected shape of an object and abnormal life symptoms of the object, and then the fall-down evaluation unit determines a fall-down condition and sends a trigger signal to request assistance. Through the contact detection unit and non-contact detection unit respectively detecting the shape and life symptoms of the object, the erroneous fall-down judgment can be reduced.

15 Claims, 5 Drawing Sheets

FALL-DOWN ALARM SYSTEM

FIELD OF THE INVENTION

The present invention relates to an alarm system and particularly to a fall-down alarm system to judge an object incapable of recuperation after falling down.

BACKGROUND OF THE INVENTION

Statistics show that falling down is the most likely cause of accidental death to people over sixty five years old, and rated as the second leading cause of accidental death in Taiwan. Other domestic and foreign research reports show that the probability of falling down occurring to the elderly is ranged from 15% to 40% per day, and increases with age. As Taiwan is gradually stepping into an aging society, the population ratio of the elderly dramatically increases. Hence how to prevent older people from accidentally falling down to risk their lives becomes an important issue demanding high attention.

An R.O.C. patent Publication No. 200919382 entitled "Fall-down detection care system equipped with multi-frame image processing function" includes multiple sets of video cameras installed in different locations and having various pre-recorded fall-down image models. Through comparing images captured by the video cameras with the pre-recorded fall-down image models, a fall-down alarm is set off when the currently recorded image is similar to the pre-recorded ones. However, video camera is expensive, and multiple sets of video cameras are even more costly in practice. Moreover, monitoring through video cameras makes people feel uncomfortable and stressed under surveillance, and, as a result, raises the concern of infringing people's privacy.

Another R.O.C. patent Publication No. 200912814 entitled "Attached movable detection apparatus" discloses a wrist-watch type detection apparatus to perform the vibration detection via acceleration and direction detection and, in turn, determine if a falling-down event happens to further set off an alarm, arousing the nearby people for necessary rescuing procedures, and/or to send emergency signals wirelessly to an rescuing institution. Such a wearable solution costs less compared to the multi-camera system and can be used anywhere, even outdoors. However, the watch-type device might be triggered by inadvertent shaking of the users themselves or accidental impact of external forces. As a result, it may very likely set off the alarm erroneously.

SUMMARY OF THE INVENTION

The primary objective of the present invention is to solve the problem of the conventional techniques that are prone to generate erroneous fall-down judgment. Another objective is to avoid infringing people's privacy caused by the video-based fall-down monitoring system.

The present invention, a fall-down alarm system, comprises a contact detection unit, a non-contact detection unit, a fall-down evaluation unit respectively connecting to the contact detection unit and the non-contact detection unit, and an alarm unit connecting to the fall-down evaluation unit.

The contact detection unit performs and outputs the pattern (s) of the contact surface between the detection unit and an object interacting with the unit. The non-contact detection unit detects and sends off the signs of life of an object through a non-contact means. The fall-down evaluation unit receives the signals from the contact and non-contact detection units and evaluates the status of the interacting object. When any abnormal conditions are suspected, the fall-down evaluation unit will send out a trigger signal to the alarm unit to set off an alarm and/or notify the pre-registered healthcare or emergency rescuing institution for assistance.

By the abovementioned technique, the shape of the contact surface and the signs of life can be detected respectively through the contact and non-contact detection units, and the alarm unit is activated only when the contact and non-contact detection signals both indicate an abnormal condition at the same time, so as to reduce the erroneous fall-down events.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
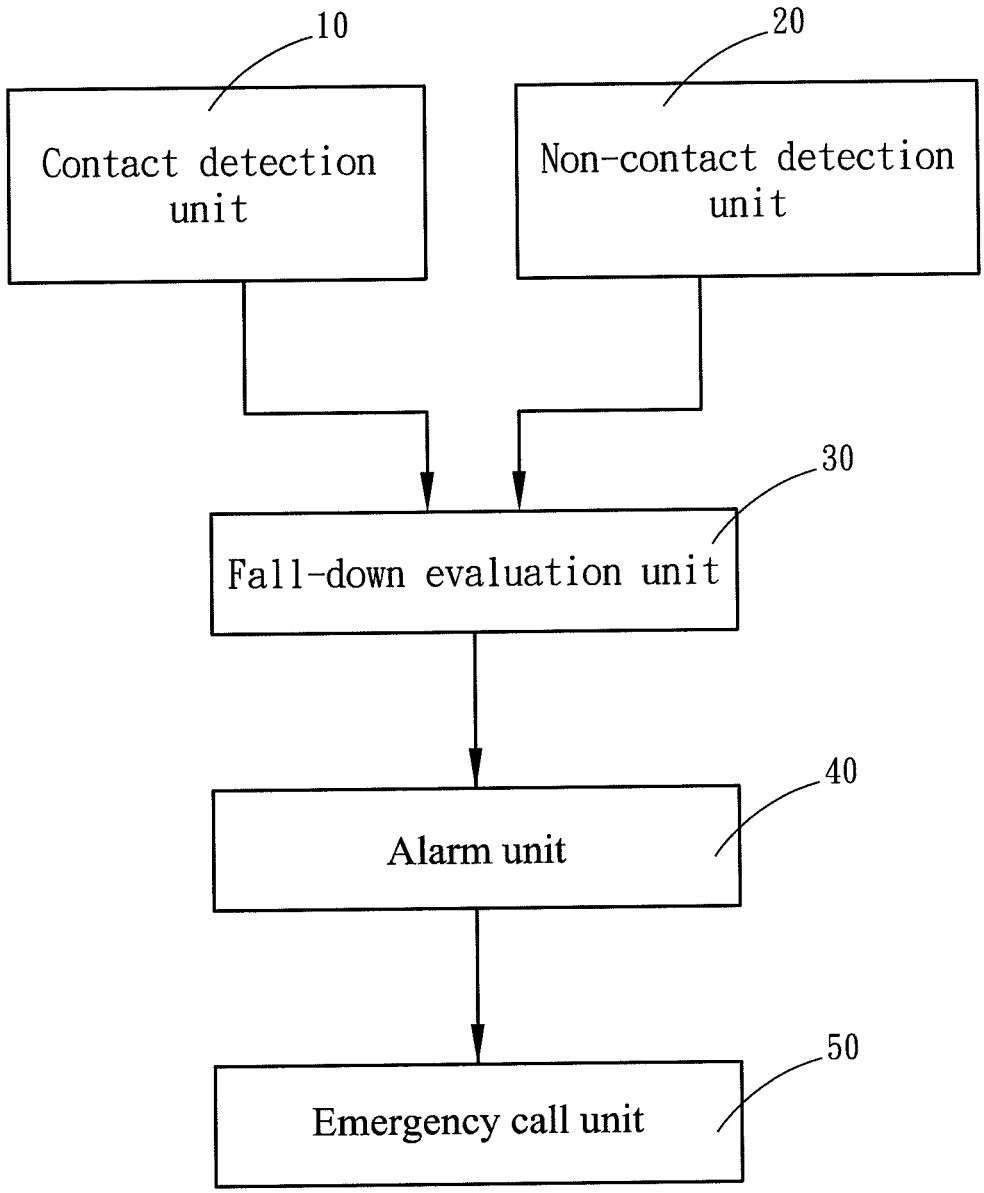
FIG. 1 is a block diagram of an embodiment of the present invention.

Please refer to FIG. 1 for a block diagram of an embodiment of a fall-down alarm system of the present invention. The fall-down alarm system of the invention includes a contact detection unit 10, a non-contact detection unit 20, a fall-down evaluation unit 30 connecting with the contact detection unit 10 and the non-contact detection unit 20 respectively, an alarm unit 40 connecting to the fall-down evaluation unit 30, and an emergency call unit 50 linked to the alarm unit 40. It should be noted that the fall-down evaluation unit is respectively linked to the contact detection unit and the non-contact detection unit via wired connection or wireless connection. The wired connection is performed through wires such as electric wires, coaxial cables or physical network wires, while the wireless connection is performed through wireless media such as wireless network, Bluetooth, infrared or radio frequency.

The contact detection unit 10 performs contact detection to an object located on the surface thereof and outputs a contact detection signal according to a detected shape of the object. The non-contact detection unit 20 detects the life symptoms of the object through a non-contact means and outputs a non-contact detection signal. The fall-down evaluation unit 30 receives the signals from the contact and non-contact detection units respectively, and sends a trigger signal to the alarm unit 40 to set off an alarm when the non-contact detection signal indicates that the life symptoms of the object are abnormal and the contact detection signal indicates that the detected shape of the object is abnormal. In addition, the fall-down evaluation unit 30 can continually monitor the signals sent from the contact detection unit at a time interval small enough to estimate the movements of the object so as to determine whether the object is abnormal. The fall-down evaluation unit 30 contains various built-in data of abnormal fall-down and life sign patterns. When a detected shape of the object is similar to or even matches one of the built-in abnormal patterns, an abnormal event is registered and the trigger signal is sent to the alarm unit 40 by the fall-down evaluation unit 30. The alarm unit 40 receives the trigger signal and sets off an alert message for emergency assistance. One of the working examples of the alarm unit 40 is a buzzer to beep upon receiving the trigger signal so as to notify nearby people for further assistance.

In addition, the alarm unit 40 can also send out the alert message to the emergency call unit 50 to call out for assistance. The target of an emergency call unit 50 can be a hospital, a nursing home or the cellphone of a care giver or any related personnel.

Figure 2:
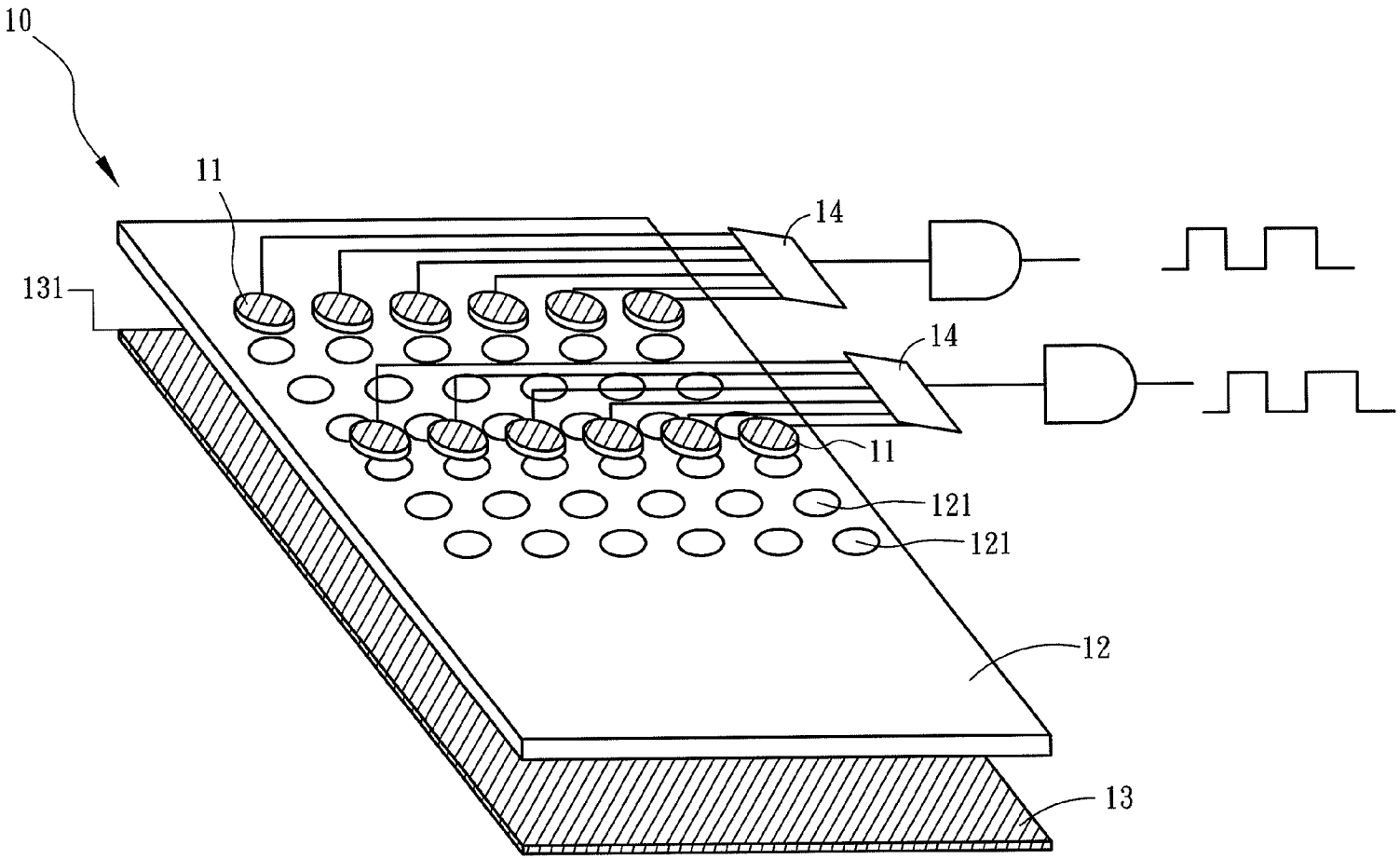
FIG. 2 is a schematic view of the contact detection unit of an embodiment of the present invention.

Also refer to FIG. 2 for the contact detection unit 10. In this embodiment, it performs the contact detection through a weight detection means, and includes a plurality of weight sensing spots 11, an insulation sheet 12 comprising a plurality of apertures 121 forming thereon and corresponding to the weight sensing spots 11, a conductive sheet 13 connecting to a power source 131 and a plurality of multiplexers 14 connecting to the weight sensing spots 11. The insulation sheet 12 is interposed between the weight sensing spots 11 and conductive sheet 13. The weight sensing spots 11 are located correspondingly to the apertures 121 to form a weight sensing array. Through detecting the weight of the object, the weight sensing spots 11 are pressed to complete an electrical loop with the conductive sheet 13 through the apertures 121 thus to generate an electric signal to the multiplexers 14. In this embodiment, each multiplexer 14 is connected with a row of multiple weight sensing spots 11. Hence the output of the multiplexer 14 can be regarded as the contact detection signal. Through the weight sensing spots 11, a weight distribution is formed on the weight sensing array in a shape to be outputted as the contact detection signal. As a result, in this embodiment, the electric signal is outputted in a digital fashion from the weight sensing spots 11 upon detecting a weight, but no signal is outputted if no weight is added to the unit. Moreover, the weight sensing spots 11 have desired resilience, and will form an electrical loop through the conductive sheet 13 only after being pressed by a sufficient load to generate electric signals. Such a design can hence avoid false alarm caused by incidental drop of some small nonhuman objects.

Aside from the weight detection previously discussed, the contact detection unit 10 can also perform the contact detection through a light blocking detection means, which only performs when an object is in contact with or very close to the contact detection unit 10 to result in light blocking. Through light luminosity degree, a blocked area and shape can be determined to output the contact detection signal. In addition, the contact detection can also be performed through reflection of light projecting on the object. Based on light reflection degree, a contact area and a shape can be determined.

The contact detection unit 10 can be wrapped within a floor carpet or anti-slip foot mat. The floor carpet can be laid around a bed, and the anti-slip foot mat can be laid in a bathroom or lavatory.

Figure 3:
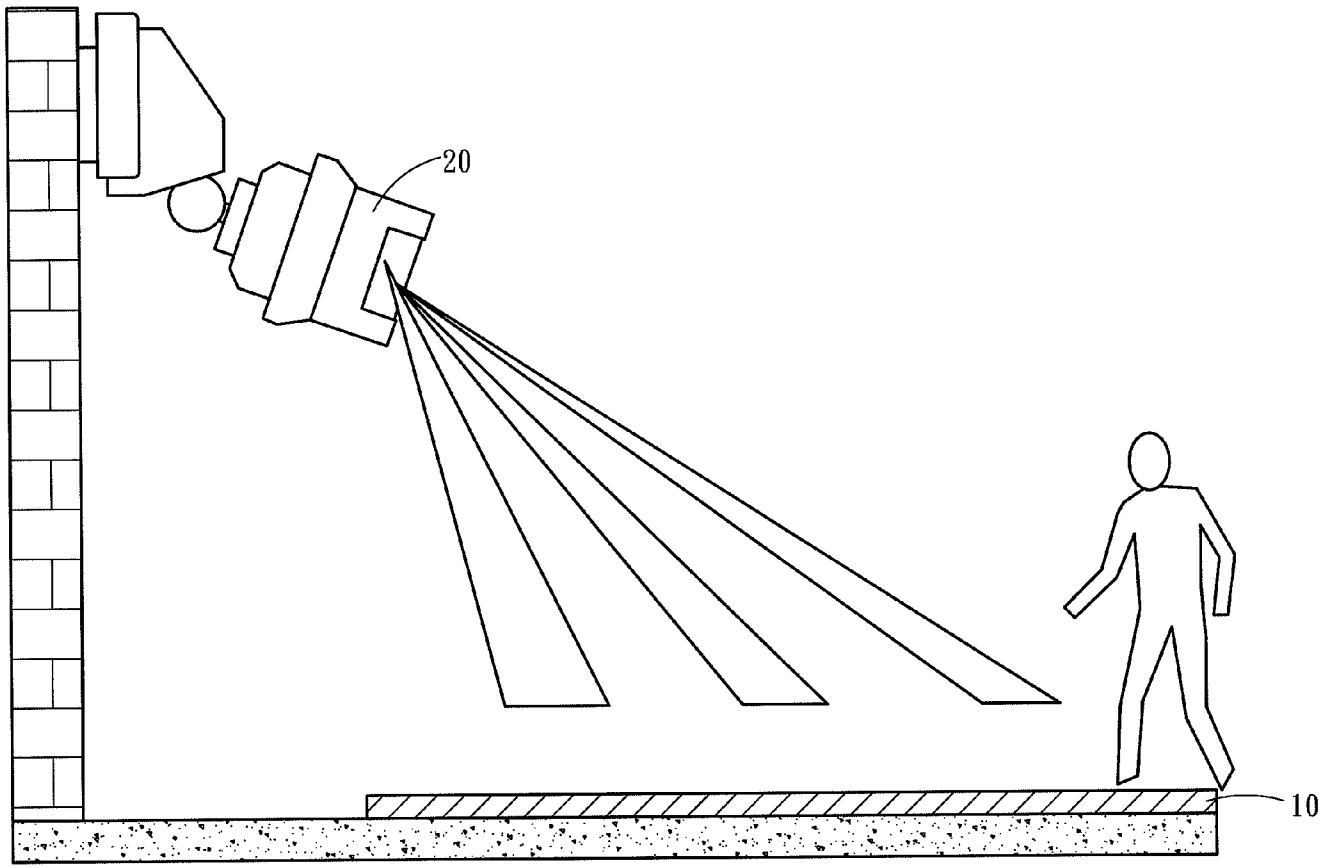
FIG. 3 is a schematic view of an embodiment of the present invention under an operational scenario.

Please refer to FIG. 3 for an embodiment of the present invention in a used condition. The non-contact detection unit 20 performs non-contact detection through an infrared detection means in this embodiment, which detecting temperature difference between the object and environment to determine the life symptoms of the object. The life symptoms mean the moving conditions of the object. More specifically, by detecting the distance between the object and the non-contact detection unit 20 through the infrared detection means, the moving conditions of the object can be obtained. By incorporating the contact detection unit 10 with the non-contact detection unit 20, the fall-down evaluation unit 30 can effectively judge whether fall-down occurs.

In addition, the non-contact detection unit 20 can also perform non-contact detection through an electromagnetic wave reflection detection means to determine the life symptoms of the object. Furthermore, the electromagnetic wave reflection detection means can even be employed to detect heart beats or breathing of the object. Through alterations of heart beats or breathing, the object can be determined whether is in an abnormal condition.

Figure 4:
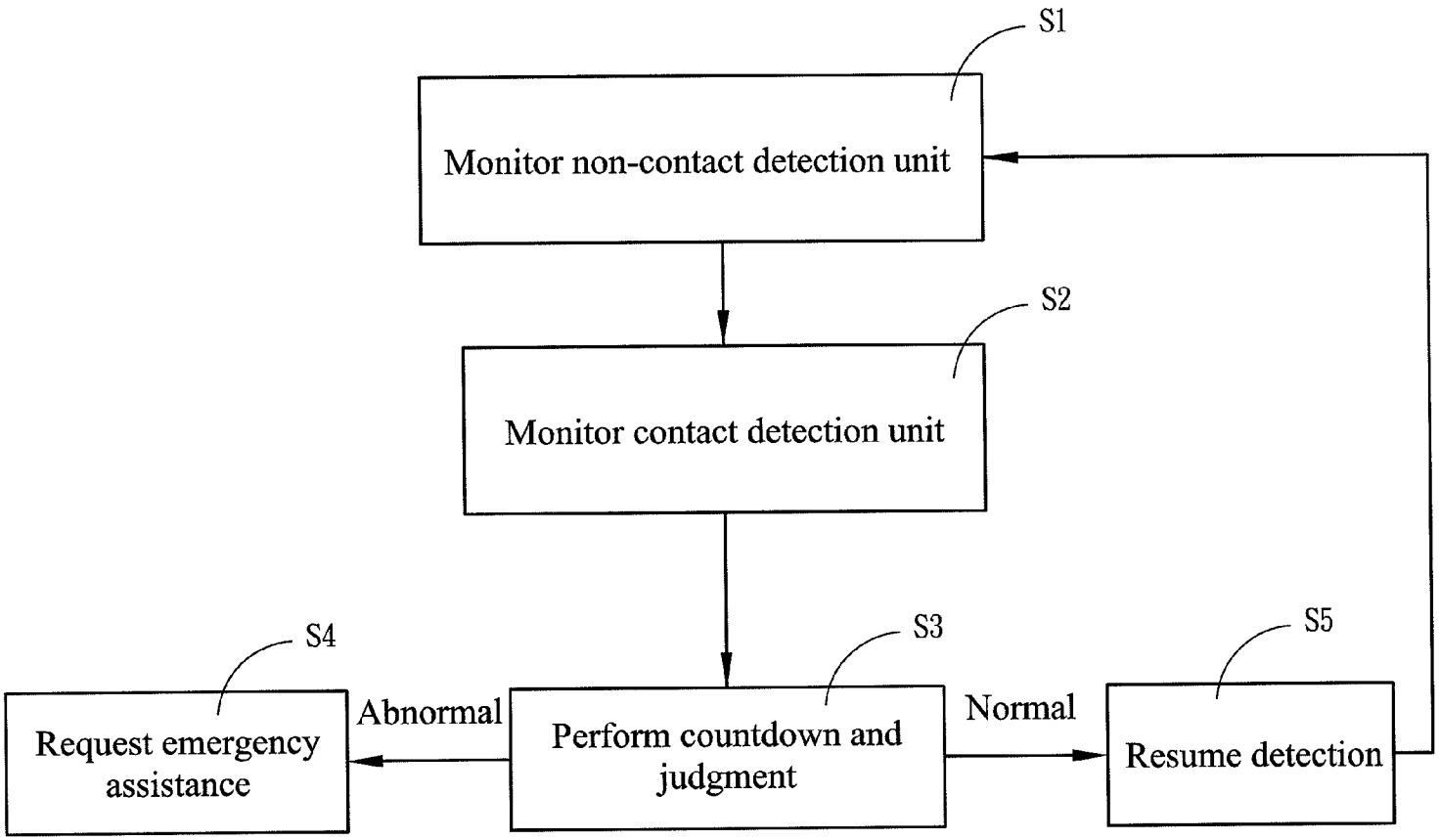
FIG. 4 is a flowchart of an embodiment of the present invention.
Figure 5:
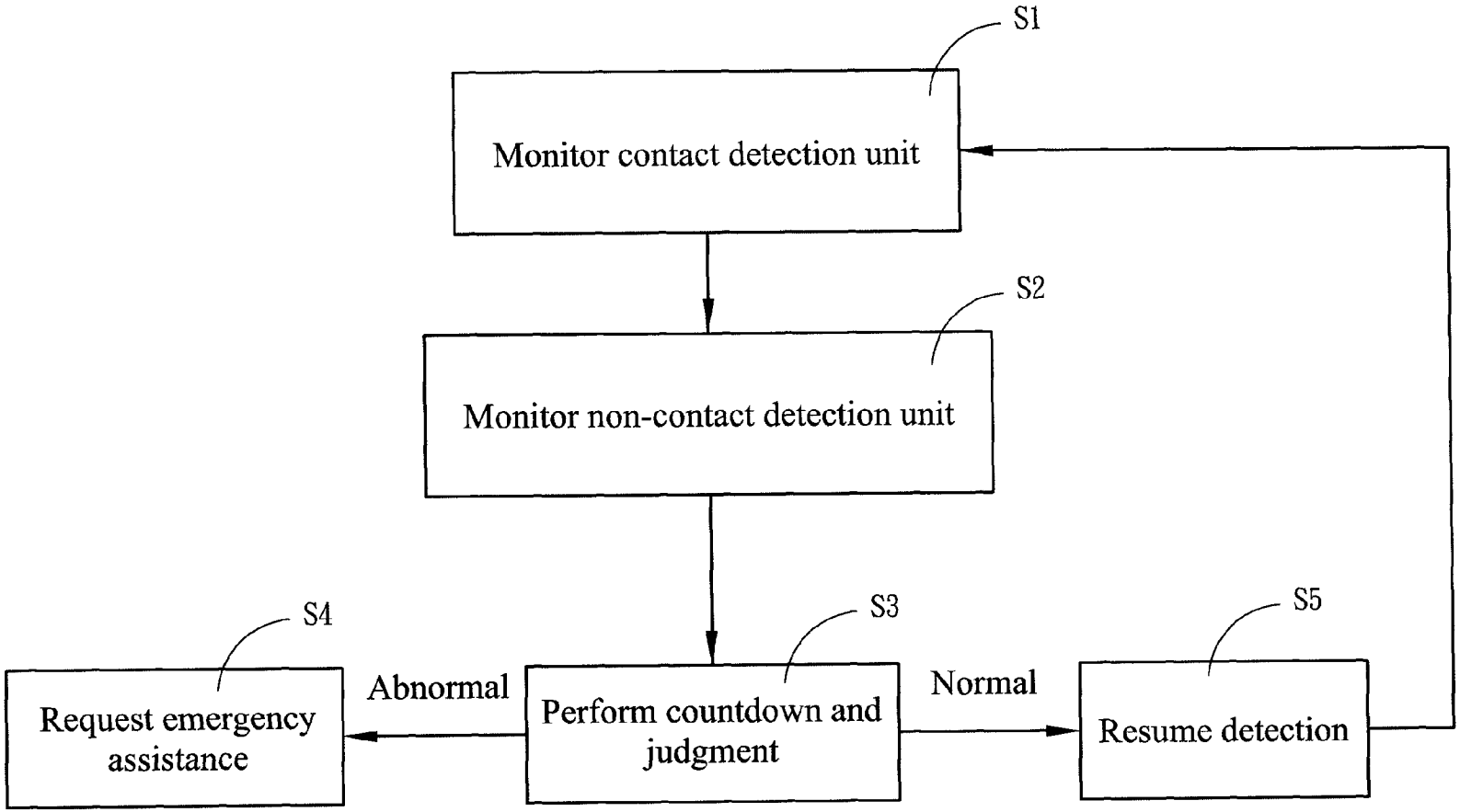
FIG. 5 is a flowchart of another embodiment of the present invention.

Please refer to FIG. 4 for the flowchart of an embodiment of the present invention. In this embodiment, the detection and judgment include the following steps:

S1: Monitor the non-contact detection unit 20. The fall-down evaluation unit 30 monitors first the non-contact detection unit 20. In the event that the non-contact detection signal indicates that the life symptoms of an object are abnormal, the fall-down evaluation unit 30 activates the power source of the contact detection unit 10 to perform contact detection.

S2: Monitor the contact detection unit 10. If the contact detection signal indicates that the detected shape of the object is abnormal, proceeding the next step.

S3: Perform countdown and judgment. After the countdown is elapsed and the detected shape resulted from contact detection still remains abnormal, the fall-down evaluation unit 30 determines an abnormal condition to send a trigger signal.

S4: Request emergency assistance. The alarm unit 40 receives the alarm signal and notices the emergency call unit 50 to request emergency assistance.

S5: Resume detection. In the event that the detected shape resulted from the contact detection is no more abnormal before the countdown is elapsed, the object is judged moving normally to resume monitoring at step S1.

While performing monitoring first through the non-contact detection unit 20 as previously discussed, another alternative is to perform monitoring first through the contact detection unit 10, the steps are illustrated as follows:

S1: Monitor the contact detection unit 10. The fall-down evaluation unit 30 monitors first the contact detection unit 10. If the contact detection signal indicates that the detected shape of the object is abnormal, the fall-down evaluation unit 30 activates the power source of the non-contact detection unit 20 to perform non-contact detection.

S2: Monitor the non-contact detection unit 20. In the event that the non-contact detection signal indicates that the life symptoms of the object are abnormal, proceeding the next step.

S3: Perform countdown and judgment. In the event that the detected shape resulted from contact detection and life symptoms resulted from non-contact detection still remain abnormal after the countdown is elapsed, the fall-down evaluation unit 30 determines an abnormal condition to issue an alarm signal.

S4: Request emergency assistance. The alarm unit 40 receives the alarm signal and notices the emergency call unit 50 to request emergency assistance.

S5: Resume detection. In the event that the detected shape resulted from the contact detection is no more abnormal before the countdown is elapsed, the object is judged moving normally to resume monitoring at step S1.

As a conclusion, the invention employs the contact detection unit 10 and non-contact detection unit 20 to respectively detect the abnormal detected shape and abnormal life symptoms. Only when both contact and non-contact detection signals indicate abnormal conditions at the same time, the alarm unit 40 is activated, thus can reduce erroneous fall-down judgment.

In addition, the non-contact detection unit 20 can perform non-contact detection through infrared detection means or electromagnetic wave reflection detection means, thus the uncomfortable feeling caused by monitoring of video cameras can be avoided. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A fall-down alarm system, comprising:

a contact detection unit to perform contact detection to an object located on a surface of the contact detection unit and output a contact detection signal according to a detected shape of the object;

a non-contact detection unit to detect life symptoms of the object through a non-contact means and output a non-contact detection signal;

a fall-down evaluation unit connecting with the contact detection unit and the non-contact detection unit to receive the contact detection signal and the non-contact detection signal respectively and send a trigger signal when the non-contact detection signal indicates that the life symptoms of the object are abnormal and the contact detection signal indicates that the detected shape of the object is abnormal; and an alarm unit connecting to the fall-down evaluation unit to set off an alert message upon receiving the trigger signal for emergency assistance, wherein the contact detection unit performs the contact detection through a weight detection means and includes a plurality of weight sensing spots to form a weight sensing array to detect weight of the object and form a weight distribution on the weight sensing array in a shape to be outputted as the contact detection signal, and wherein the contact detection unit further includes an insulation sheet with a plurality of apertures formed thereon and corresponding to the weight sensing spots, a conductive sheet connecting to a power source and a plurality of multiplexers connecting to the weight sensing spots, the weight sensing spots being located correspondingly to the apertures to form the weight sensing array; through detecting the weight of the object, the weight sensing spots being pressed to complete an electrical loop with the conductive sheet through the apertures to generate an electric signal.

2. The fall-down alarm system of claim 1, wherein the alarm unit is a buzzer to beep upon receiving the trigger signal so as to notify nearby people for further assistance.

3. The fall-down alarm system of claim 1, wherein the alarm unit is linked to an emergency call unit which receives the alert message from the alarm unit to call out for assistance.

4. The fall-down alarm system of claim 1, wherein the contact detection unit is wrapped within a floor carpet or an anti-slip foot mat.

5. The fall-down alarm system of claim 1, wherein the contact detection unit performs the contact detection through a light blocking detection means to determine a blocked shape via light luminosity degree to output the contact detection signal.

6. The fall-down alarm system of claim 1, wherein the contact detection unit performs the contact detection through reflection of light projecting on the object to determine a contact area and a shape via light reflection degree.

7. The fall-down alarm system of claim 1, wherein the non-contact detection unit performs non-contact detection through an infrared detection means by detecting temperature difference between the object and environment to determine the life symptoms of the object.

8. The fall-down alarm system of claim 1, wherein the non-contact detection unit performs non-contact detection through an electromagnetic wave reflection detection means to determine the life symptoms of the object.

9. The fall-down alarm system of claim 1, wherein the fall-down evaluation unit performs countdown upon receiving the contact detection signal indicating that the detected shape of the object is abnormal; after the countdown being elapsed and the detected shape remaining abnormal, the fall-down evaluation unit determining an abnormal condition to send the trigger signal.

10. The fall-down alarm system of claim 1, wherein the fall-down evaluation unit monitors first the non-contact detection unit, and then monitors the contact detection unit after the non-contact detection signal has indicated that the life symptoms of the object are abnormal, and sends the trigger signal when the contact detection signal indicates that the detected shape of the object is abnormal.

11. The fall-down alarm system of claim 1, wherein the fall-down evaluation unit monitors first the contact detection unit, and then monitors the non-contact detection unit after the contact detection signal has indicated that the detected shape of the object is abnormal, and sends the trigger signal when the non-contact detection signal indicates that the life symptoms of the object are abnormal.

12. The fall-down alarm system of claim 1, wherein the fall-down evaluation unit is respectively linked to the contact detection unit and the non-contact detection unit via wired connection.

13. The fall-down alarm system of claim 12, wherein the wired connection is performed through wires selected from the group consisting of electric wires, coaxial cables and physical network wires.

14. The fall-down alarm system of claim 1, wherein the fall-down evaluation unit is respectively linked to the contact detection unit and the non-contact detection unit via wireless connection.

15. The fall-down alarm system of claim 14, wherein the wireless connection is performed through wireless media selected from the group consisting of wireless network, Bluetooth, infrared and radio frequency.

* * * * *